United States Patent [19]

Takahashi

[11] 4,132,510

[45] Jan. 2, 1979

[54] COMPRESSOR

[75] Inventor: Shigeo Takahashi, Kawasaki, Japan

[73] Assignee: Sampei Komiya, Gumma, Japan

[21] Appl. No.: 803,848

[22] Filed: Jun. 6, 1977

[51] Int. Cl.[2] ..... F04B 39/02; F04B 21/04

[52] U.S. Cl. ..... 417/534; 92/255; 92/153

[58] Field of Search ..... 417/534–539, 417/571; 92/255, 153

[56] References Cited

U.S. PATENT DOCUMENTS

| | | | |
|---|---|---|---|
| 2,055,096 | 9/1936 | Phillips et al. | 417/536 |
| 2,614,009 | 10/1952 | Butterfield | 92/255 |
| 2,779,644 | 1/1957 | Lovatt | 92/255 |
| 3,160,229 | 12/1964 | Teresawa | 417/539 |
| 3,456,874 | 7/1969 | Graper | 417/571 |
| 3,834,840 | 9/1974 | Hartley | 417/535 |

FOREIGN PATENT DOCUMENTS

| | | | |
|---|---|---|---|
| 531471 | 10/1921 | France | 417/524 |
| 1017178 | 12/1952 | France | 92/255 |
| 991775 | 5/1965 | United Kingdom | 417/534 |

*Primary Examiner*—William L. Freeh

*Attorney, Agent, or Firm*—Toren, McGeady and Stanger

[57] ABSTRACT

A compressor of a Scotch-yoke type, which includes: a piston consisting of a pair of bottomed cylindrical members, with the open ends of the members being mated with each other; a slider confined between the opposed bottoms of the piston, and slidable along the inner surfaces thereof in the direction perpendicular to the axis of the piston; and a crank cam secured to a drive shaft extending through opposed openings defined in the wall of piston, i.e., in a mated portion of the cylindrical members, and fitted in a bore provided in the slider rotatably. In this compressor, the aforesaid mated portion of the bottomed cylindrical members are further provided with opposed openings or windows in the direction of the reciprocating or sliding slider, so that parts of flanks of the slider may go into the aforesaid windows, thereby increasing a stroke of the piston. In addition, respective bottom walls of the cylinder, in which the piston is slidingly fitted, are provided with valve mechanisms, which allow both inflow and outflow of a fluid in response to the reciprocating movement of the piston within the cylinder. Assuming that the direction of a drive shaft having a cam slidingly fitted in the bore in the slider is longitudinal, then the direction of the reciprocating piston is vertical, and the direction of the reciprocating slider is lateral.

3 Claims, 8 Drawing Figures

COMPRESSOR

BACKGROUND OF THE INVENTION

Field of the invention

This invention relates to a compressor, and more particularly to a Scotch-yoke type compressor, in which a piston is slidingly reciprocated in a cylinder, without using a piston rod.

Description of the prior art

In the prior art compressors of the type described, a slider, which interconnects a piston and a crank pin secured to a drive shaft, is positioned externally of the piston, so that a space required for the slider should be provided externally of the piston, thus leading to a difficulty in reducing the size of a compressor.

In addition, an impact sound produced therefrom is considerably high in level, and a lubricating system for piston and slider is complicated and hence not satisfactory in this sense.

The compressor of this type finds a wide application in an electric refrigerator which is operated in a satisfactory environmental condition at a constant rotational speed, and undergoes no limitation arising from a refrigerating period of time. However, if a compressor of this type is applied to a cooler in an automobile, in which a space for a compressor should minimized, then the construction of a compressor becomes complex, and the length of the compressor should be increased in the axial direction of a drive shaft, because the drive shaft is supported in a cantilever fashion. This leads to a limitation on the size of a slider relative to a diameter of a piston (These attempts are disclosed in the Japanese Laid-Open Patent Applications. Nos. 49-56206 and 50-125304.)

SUMMARY OF THE INVENTION

It is a principal object of the present invention to provide a compressor of the Scotch-yoke type, whose size is compact, as compared with that of a prior art compressor of this type.

It is another object of the present invention to provide a compressor of the Scotch-yoke type, which is devoid of impact-sound and vibration problems.

It is a further object of the present invention to provide a compressor which provides smooth lubrication between a piston and a slider.

It is yet a further object of the present invention to provide a compressor which allows smooth sliding contact of a slider with the inner surfaces of a piston.

According to the present invention, there is provided a compressor of the Scotch-yoke type, which includes: a piston consisting of a pair of bottomed cylindrical members, with the open ends of the members mated with each other; a slider confined between the opposed bottoms of the piston, and slidable therealong in the direction perpendicular to the axis of the piston; and a crank cam secured to a drive shaft extending through opposed openings defined in the wall of the piston, i.e., in a mated portion of the cylindrical members, and fitted in a bore provided in the slider rotatably. In this compressor, the aforesaid mated portion of the bottomed cylindrical members are further provided with opposed windows in the direction of reciprocating or sliding slider, so that parts of flanks of the slider may go into the aforesaid windows, thereby allowing to increase a stroke of the piston. In addition, respective bottom or end plates of the cylinder, in which the piston is slidingly fitted, are provided with valve mechanisms which allow both inflow and outflow of a fluid in response to the reciprocating movement of the piston within the cylinder.

According to another aspect of the present invention, the slider is fitted in guide grooves defined in the inner surfaces of bottom walls of the piston.

According to a further aspect of the present invention, the aforesaid guide grooves are provided in the form of ridge portions formed on the inner surfaces of bottom walls of the piston.

According to a still further aspect of the present invention, the opposite edges of sliding surfaces of leg portions of the slider are subjected to crowning are chamfered, thereby enabling the smooth sliding contact of the leg portions of the slider with the guide grooves provided in the inner surfaces of bottom walls of the piston.

According to a further aspect of the present invention, a lubricating oil supply passage is provided in a drive shaft and a crank cam, while another lubricating oil passage is provided in a slider in register with an opening of the aforesaid lubricating oil supply passage, with a recessed oil sump being provided in sliding surfaces of leg portions of the slider, which surfaces are fitted in the guide grooves provided in the inner surfaces of bottom walls of the piston.

DESCRIPTION OF THE PREFERRED EMBODIMENTS

Figure 1:
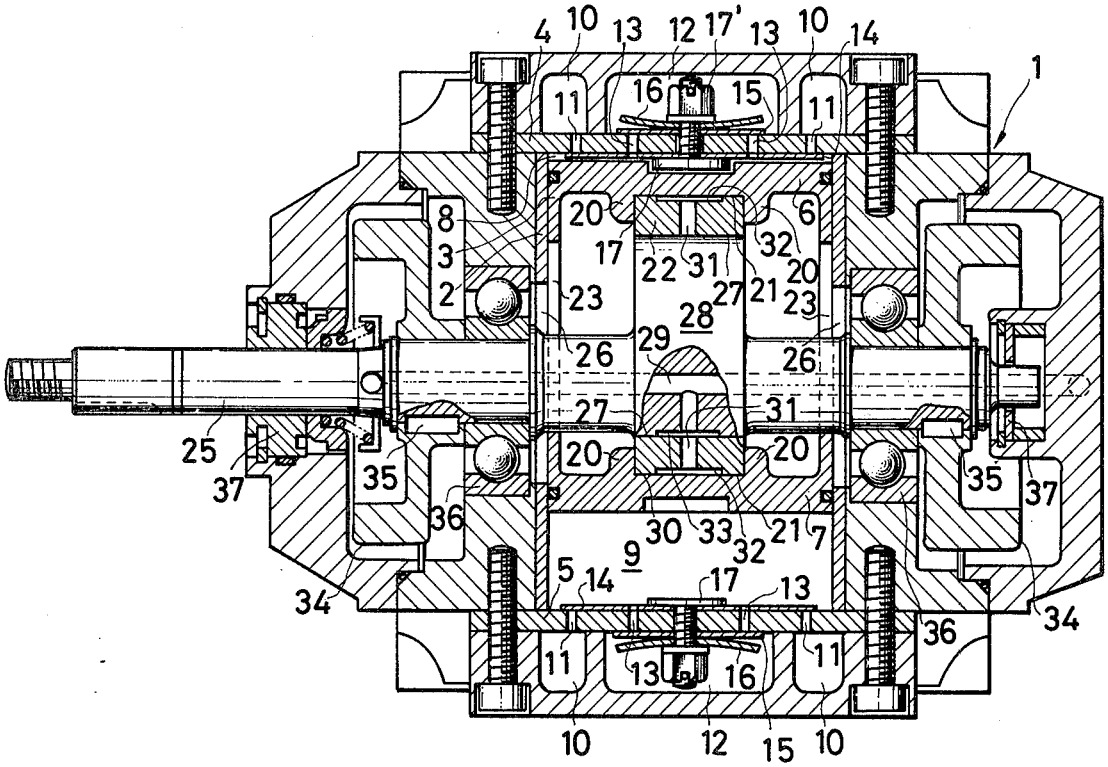
FIG. 1 is a detailed longitudinal cross-sectional view of one embodiment of a compressor according to the present invention.

Referring first to FIG. 1, there is shown at 1 a body proper of a compressor. The body proper 1 of the compressor includes a cylinder 2, while a piston 3 is slidingly fitted in the cylinder 2. The opposite open ends of the cylinder 2 are closed with bottom plates 4, 5, which form variable working chambers 8, 9 in cooperation with bottom walls 6, 7 of piston 3. Shown at 10 are fluid or gas supply passages which are communicated with a supply port (not shown) on one hand and with working chambers 8, 9 through communicating holes 11, 11 . . . provided in the bottom plates 4, 5 of the cylinder 2, on the other. The communicating holes 11, 11 . . . are provided in an annular form, while the passages 10, 10 are also provided in an annular form.

Shown at 12 is an outlet passage communicated with an outlet not shown. The outlet passages 12 are bounded by the bottom plates 4, 5 outwardly thereof and communicated through communicating holes 13, 13 . . . with the working chambers 8, 9, respectively. The communicating holes 13, 13 . . . are positioned in central portions of the bottom plates 4, 5 in an annular form.

Secured to the surfaces of bottom plates 4, 5 of the cylinder 2 on the side of working chambers 8, 9 are valve plates 14, 14 made of a soft spring material and adapted to close the communicating holes 11, 11 . . . , while valve plates 15, 15 made of a soft spring material are secured to the bottom plates 4, 5 on the side of outlet passage 12. Washers 16, 16 are superposed on top of the valve plates 15, 15, while the washers 16, valve plates 15, and valve plates 14 are tightened together by means of bolts 17 and nuts 17'. Holes are provided in the valve plates 14, 14 in register with the communicating holes 13, 13 provided in the bottom plates 4, 5. In addition, the bottom walls 6, 7 of piston 3 are outwardly formed thereof with recesses, into which head portions of bolts 17, 17 may enter.

Figure 3:
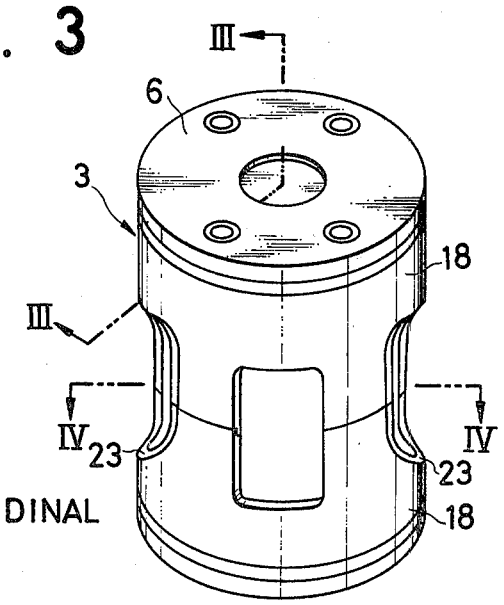
FIG. 3 is a perspective view of a piston.
Figure 2:
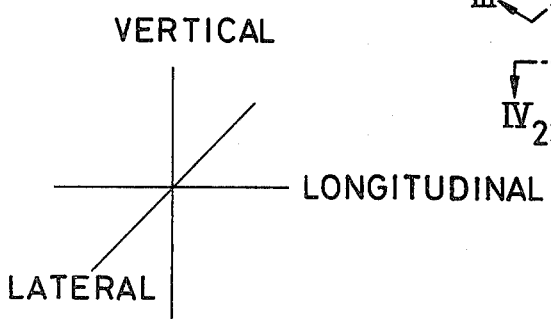
FIG. 2 is a view illustrative of the direction of axis of a drive shaft and directions of reciprocating piston and slider.
Figure 4:
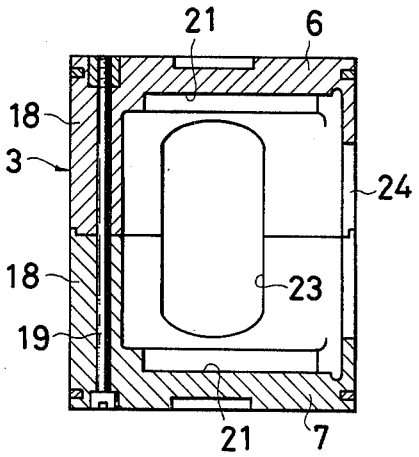
FIG. 4 is a cross-sectional view taken along the line III—III of FIG. 3.
Figure 5:
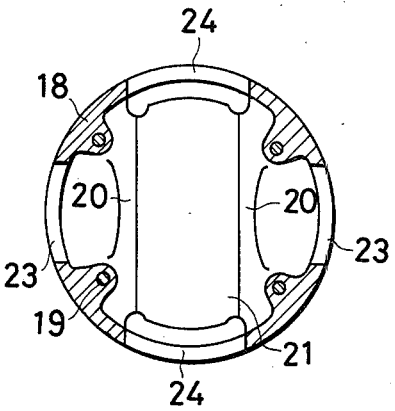
FIG. 5 is a cross-sectional view taken along the line IV—IV of FIG. 3.
Figure 6:
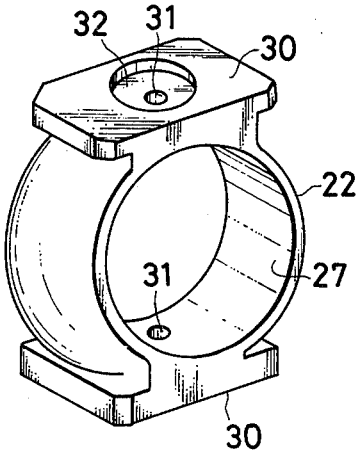
FIG. 6 is a perspective view of a slider according to the present invention.
Figure 8:
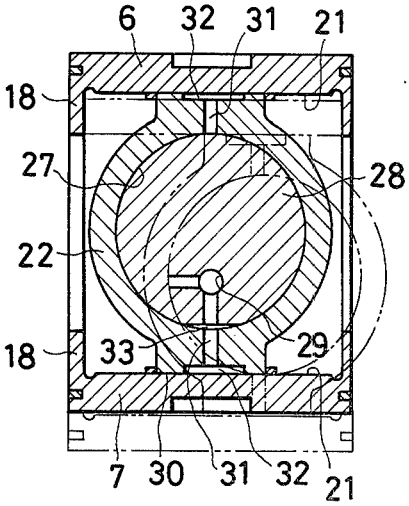
FIG. 8 is a view showing the assembled condition of piston and slider, particularly lubricating-oil-supply passages.

Referring to FIGS. 3, 4, bottomed cylindrical members 18, 18 are fastened together by means of bolts 19, 19 . . . , with the open ends of the members 18, 18 being mated with each other, and the bolts 19, 19 extend through the members 18, 18 in the axial direction. A pair of parallel ridge portions 20, 20 are formed on the inner surfaces of the bottom walls 6, 7 of piston 3 in the direction perpendicular to the axis of piston 3, respectively. Two pairs of ridge portions 20, 20 define a pair of guide grooves 21, one pair on one side. Shown at 22 is a slider, whose leg portions are slidingly fitted in the guide grooves 21, 21 in the lateral direction of a compressor, respectively. As shown in FIG. 2, the piston 2 reciprocates in the vertical direction, assuming that the direction of axis of a drive shaft 25 is longitudinal. As shown in FIG. 3, shaft holes 23, 23 are provided in a mated portion of walls of the cylindrical members 18, 18 in opposed relation, while windows 24, 24 are provided in the wall of the piston in the positions which are angularly spaced 90° from the shaft holes 23, 23. The positions of windows 24, 24 are in alignment with the direction of reciprocating slider 22. As a result, parts of flanks of the slider may enter into the windows 24, 24 at the extremities of a stroke of the slider. The drive shaft 25 is journalled in the body proper 1 of a compressor. The drive shaft 25 extends through cut-away portions 26, 26 provided in the wall of the cylinder 2, as well as through the shaft holes 23, 23 in the piston 3, in addition to the cam bore 27 provided in the slider 22. Secured on the drive shaft 25 is a crank cam 28 as shown in FIG. 8, and the crank cam 28 is rotatingly fitted in the cam bore 27 provided in the slider 22. Meanwhile, the crank cam 28 is secured on the drive shaft 25 in eccentric relation, so that the eccentric rotation of the crank cam 28 causes the slider 22 to slide on the inner surfaces of piston 3 in the lateral direction, and the piston 3 reciprocates within the cylinder 2 in the vertical direction as has been described earlier with reference to FIG. 2.

Figure 7:
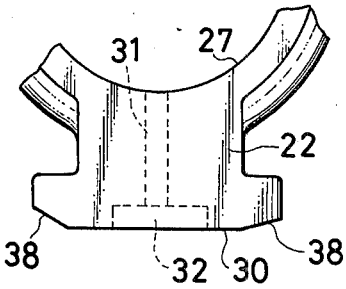
FIG. 7 is an enlarged view of part of the slider, including its leg portion.

An oil supply hole 29, as shown in FIG. 8, is provided in the drive shaft 25 which causes the reciprocating movement of piston 3 through the medium of slider 22. The oil supply hole 29 is connected to a source of lubricating oil, and the oil supply hole 29 is open from the peripheral surface of crank cam 28. As shown in FIG. 8, communicating holes 31, 31 are provided in leg portions of the slider 22 in a manner to communicate both with the sliding, peripheral surface of the crank cam 28 and with the sliding surfaces 30, 30 of the leg portions of slider 22 along the inner surfaces of the bottom walls 5, 6 of piston 3. Shallow recessed oil sumps 32, 32 are provided in the sliding surfaces 30, 30 of leg portions of the slider in communication with the communicating holes 31, 31. Shown at 33 is a communicating chamber which is communicated with an open end of the oil supply hole 29. Shown at 34 are fly wheels which are secured to the drive shaft 25 through the medium of keys 35, 35. Shown at 36, 36 are bearings, and at 37, 37 are seal members. The opposite ends of the sliding surfaces of leg portions of slider 22 are formed with chamfered portions or inclined portions 38, 38 which are prepared according to crowning, as shown in FIG. 7.

In operation of a compressor thus arranged, when the drive shaft 25 is rotated, crank cam 28 secured on shaft 25 is rotated in eccentric fashion, so that the slider 22 reciprocates within the piston 3 in the lateral direction, while the piston 3 reciprocates within the cylinder 2 in the vertical direction. A fluid or gas supplied into the supply passage 10 then thn introduced through the communicating holes 11, 11 . . . in response to expansion and compression of working chambers 8, 9, while being controlled under a valving action of the valve plates 14, 14, while fluid or gas is discharged from the working chamber 8, 9 through outlet passage 12 under a valving action of valve plates 13, 13.

As is apparent from the foregoing description of the compressor and crank cam 28 which provide a Scotch-yoke mechanism are built in the piston 3, thereby eliminating a need to provide a Scotch-yoke mechanism externally of the piston 3, as in the case of the prior art compressor, thus allowing reduction in size of the compressor. In addition, the slider 22 has sliding surfaces 30, 30 which are fitted in the guide grooves 21, 21 in the inner surfaces of bottom walls 6, 7 of piston 3, thereby avoiding longitudinal vibrations of the slider 22, during eccentric rotation of crank cam 28, and allowing a stroke of the piston 3 to be maintained constant, with the accompanying achievement of smooth reciprocating movement of piston 3.

Meanwhile, shallow oil sumps 32, 32 are provided in the sliding surfaces 30, 30 of leg portions of slider 22, thereby allowing smooth lubrication between slider 22 and piston 3. In addition to this, an impact force created by a reaction of compression at the extremities of a stroke of piston 3 may be absorbed by lubricating oil stored in the oil sumps 32, 32, thereby avoiding impact sound and vibrations stemming from the aforesaid impact force.

Still furthermore, windows 24, 24 are provided in the wall of piston 3, so that parts of flanks of the slider 22 may enter therein, thus increasing a stroke of the slider 22 as well as a stroke of the piston 3, relative to the inner diameter of the piston 3. This contributes to reducing the size of a compressor. Yet furthermore, the opposite ends of the sliding surfaces 30, 30 of leg portions of slider 22 are chamfered or subjected to crowning, thereby allowing smooth sliding contact of the slider 22 with the inner surfaces of bottom walls of piston 3.

In short, according to the present invention, there is provided a compressor which is simple in construction and compact in size, while insuring positive and smooth movements of piston and slider and eliminating vibration and sound problems, from which prior art compressors have thus far suffered.

Although the present invention has been described with respect to specific details of certain embodiments thereof, it is not intended that such details be limitations upon the scope of the invention except insofar as set forth in the following claims.

What is claimed is:

1. A compressor of the Scotch-yoke type, comprising a compressor body, a hollow cylinder positioned in said compressor body, means closing the opposite ends of said cylinder, a piston fitted in said cylinder and being slidable therein in the axial direction of said cylinder, said piston comprising a pair of hollow cylindrical members each having a cylindrically shaped axially extending side wall, an end wall closing one end of said side wall with the other end thereof being open, the open ends of said side walls disposed in mated engagement with one another, bolts penetrating through said side walls of said cyclindrical members in the axial direction thereof for securing said cylindrical members together, each said end wall having a surface facing the other said end wall with a guide groove formed in each of the facing surfaces and extending perpendicularly of the axial direction of said piston, a pair of diametrically opposed shaft holes and a pair of diametrically opposed windows provided in the side walls of said cylindrical members with said pair of shaft holes being disposed angularly spaced by 90° from said pair of windows, said cylinder and said means closing the ends thereof in combination with said end walls of said piston defining a pair of variable working chambers each located at an opposite end of said piston, a slider positioned within said piston and having a circular cam hole therethrough with the axis of said cam hole extending perpendicular of the axis of said piston, a sliding surface provided on each of the opposite ends of said slider which extend transversely of the axis of said piston with each of said sliding surfaces disposed in sliding contact with a different one of the said guide grooves of said piston, said slider being movably displaceable in said piston in the direction perpendicular to the axial direction of said piston so that during a part of the slider movement the slider protrudes through each of said windows in said piston, a drive shaft extending into said compressor body and through said cylinder and said shaft holes in said piston with said shaft extending perpendicularly of the axis of said piston and perpendicularly of the sliding direction of the sliding surfaces on said slider, a crank cam eccentrically mounted on said shaft for rotation therewith and said crank cam positioned in said cam hole in said slider so that the driving force of said shaft can be conveyed through said crank cam to said slide, a plate-like oil sump formed in each of the sliding surfaces of said slider in the surface thereof disposed in sliding engagement with said guide grooves of said piston, a communicating hole opened through said slider between each of said oil sumps and said cam hole, an oil supply hole for supplying lubricating oil extending axially through said shaft and a lateral hole in said shaft extending outwardly from said oil supply hole through said shaft for connection to said communicating holes as said shaft rotates for supplying oil to said oil sumps.

2. A compressor as set forth in claim 1, wherein each of said guide grooves is defined by a pair of ridge portions provided on the inner surfaces of said end walls of said cylindrical members forming said piston.

3. A compressor as set forth in claim 1, wherein the opposite ends of the sliding surfaces of said slider in the sliding direction are beveled.

* * * * *

UNITED STATES PATENT OFFICE

CERTIFICATE OF CORRECTION

Patent No. 4,132,510 Dated January 2, 1979

Inventor(s) SHIGEO TAKAHASHI

It is certified that error appears in the above-identified patent and that said Letters Patent are hereby corrected as shown below:

In the heading of the Patent [30] should read as follows:

[30] Foreign Application Priority Data

Japan - June 9, 1976.....51-66470

Japan - Feb.23, 1977.....52-18053

Signed and Sealed this

Third Day of April 1979

[SEAL]

Attest:

RUTH C. MASON
Attesting Officer

DONALD W. BANNER
Commissioner of Patents and Trademarks